US005149279A

United States Patent [19]

Kruse

[11] Patent Number: 5,149,279

[45] Date of Patent: Sep. 22, 1992

[54] PUSH-IN ELECTRICAL CONNECTOR ASSEMBLY

[76] Inventor: Robert W. Kruse, 219 Warren Ave., Rockford, Ill. 61107

[21] Appl. No.: 528,046

[22] Filed: May 23, 1990

[51] Int. Cl.[5] ..... H01R 4/24

[52] U.S. Cl. ..... 439/441

[58] Field of Search ..... 439/436–441, 439/434, 861, 862

[56] References Cited

U.S. PATENT DOCUMENTS

| | | | |
|---|---|---|---|
| 2,122,252 | 3/1935 | Hayes . | |
| 2,983,894 | 5/1961 | Lawson et al. | 439/436 |
| 3,918,784 | 11/1975 | Lemke et al. . | |
| 3,945,711 | 3/1976 | Hohorst et al. . | |
| 4,036,545 | 7/1977 | Mysiak et al. . | |
| 4,056,299 | 11/1977 | Paige . | |
| 4,212,509 | 7/1980 | Brooks et al. . | |
| 4,397,514 | 8/1983 | Durand et al. . | |
| 4,566,748 | 1/1986 | Tanishi et al. . | |
| 4,585,902 | 4/1986 | Munroe . | |
| 4,751,350 | 6/1988 | Eaton . | |
| 4,790,772 | 12/1988 | Schulte et al. . | |
| 4,822,288 | 4/1989 | Conley | 439/434 |
| 4,824,395 | 4/1989 | Blaha et al. . | |

*Primary Examiner*—Joseph H. McGlynn
*Attorney, Agent, or Firm*—Reinhart, Boerner, Van Deuren, Norris & Rieselbach

[57] ABSTRACT

A push-in electrical connector assembly for electrically connecting stripped ends of a plurality of electrical wires. The connector assembly comprises a housing of electrical insulating material, and axially elongated central conductor member, and a generally frusto-conical metal clamp member formed of resilient metal concentric with the central conductor member. The clamp member has a plurality of resilient finger portions integrally joined at one end and arranged in a generally frusto-conical array that converges to the central conductor member to resiliently press wires against the central conductor member and thereby electrically connect the wires.

24 Claims, 2 Drawing Sheets

Fig. 1
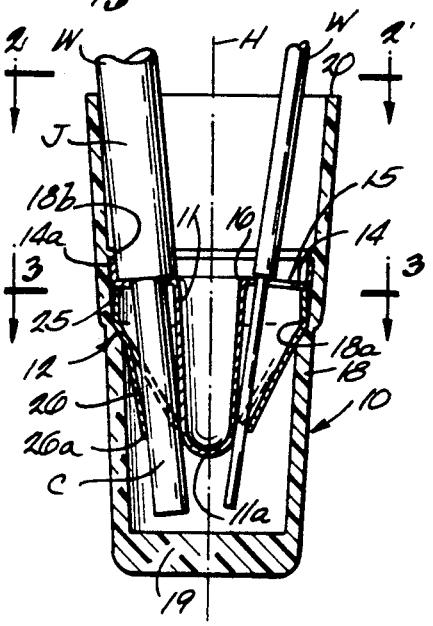
Fig. 2
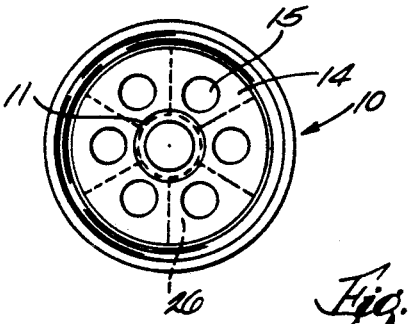
Fig. 3
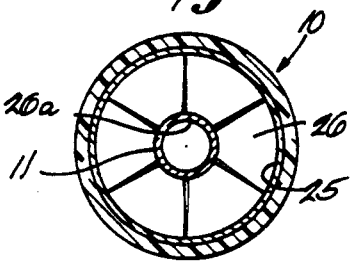
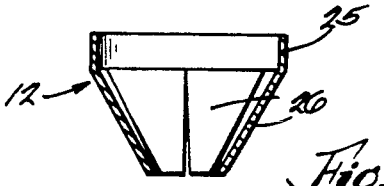
Fig. 4
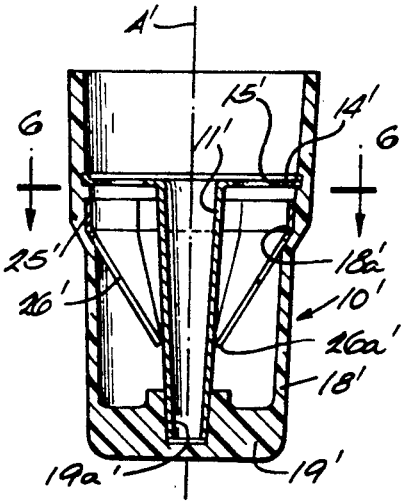
Fig. 5
Fig. 6
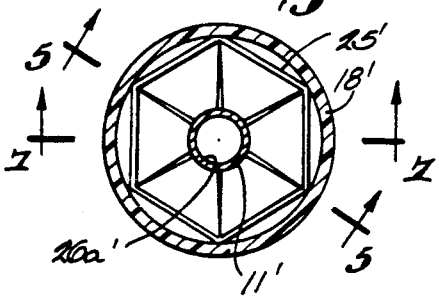
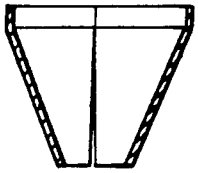
Fig. 7

PUSH-IN ELECTRICAL CONNECTOR ASSEMBLY

BACKGROUND OF THE INVENTION

This invention relates generally to wire connectors and, more particularly, to push in wire connectors.

Various push-in wire connectors have heretofore been made. These devices electrically connect two or more wires when the individual wires are pushed into the connector. Some push-in connectors, such as those disclosed in U.S. Pat. Nos. 4,397,514 and 4,824,395, arrange the wires in a single row in side-by-side relation. In some others, such as those disclosed in U.S. Pat. Nos. 4,566,748 and 4,585,902, the wires are disposed in side-by-side relation in two parallel rows. Frequently, however, it is desired to provide connectors that can accommodate a large number of wires, for example five to eight wires, and the overall size of such wire connectors becomes quite large. In addition, when the wires inserted into the connector are arranged in one or two rows, it is difficult to bend the wires in a direction other than laterally of the row when pressing the wires and connectors into an electrical junction box.

In some push-in connectors, such as those disclosed in U.S. Pat. Nos. 4,585,902 and 4,824,395, the electrical connection between adjacent wires is established only through a single wire clip formed of resilient metal. Some other push-in connectors, such as those disclosed in U.S. Pat. Nos. 3,945,711; 4,397,514; and 4,566,748, include a resilient metal contact member for pressing the electrical conductors against a base contact member. The resilient metal contact member and the base contact member coact to provide electrically conductive paths among the wires when they are inserted into the connector. However, such prior push-in type connectors using a resilient metal contact member to press the wires into engagement with a base contact member have been somewhat expensive to fabricate and assemble.

SUMMARY OF THE INVENTION

It is an object of the present invention to provide a push-in electrical connector assembly for electrically connecting the stripped ends of a plurality of wires, and which has a small overall size to occupy a minimum space in an electrical junction box.

Another object of the present invention is to provide a push-in electrical assembly for electrically connecting stripped ends of a plurality of electrical wires, and which can be economically formed and assembled into an insulating housing.

Another object of this invention is to provide a push-in electrical connector assembly for electrically connecting stripped ends of a plurality of electrical wires, and which provides a short, electrically conductive path among all of the wires when they are inserted into the connector assembly.

The invention provides a push-in electrical connector assembly for electrically connecting the stipped ends of a plurality of electrical wires. The connector assembly includes a housing having an interior cavity and an elongate electrically conductive member disposed within the interior cavity. A wall at one end of the interior cavity defines a plurality of wire receiving passages that communicate with the interior cavity and that are arranged in a generally circular locus around the electrically conductive member. A retainer within the interior cavity biases the stripped ends of the electrical wires into contact with the electrically conductive member and resists withdrawal of the stripped ends of the electrical wires from the interior cavity when the stripped ends of the electrical wires are inserted into the interior cavity through the wire receiving passages.

The invention also provides a push-in electrical connector assembly for electrically connecting the stripped ends of a plurality of electrical wires, the connector assembly comprising a housing of electrically insulating material defining a connector cavity, wall means at a side of a cavity providing a plurality of wire receiving passages communicating with the cavity and arranged in a generally circular locus, an axially elongated central conductor member of electrically conductive material disposed in the cavity with the lengthwise axis aligned with the center of the circular locus, and a resilient generally frusto-conical metal clamp member disposed in the cavity and surrounding the central conductor member for resiliently pressing the wires inserted into the cavity against the central conductor member. The resilient metal clamp member has an annular portion coaxial with the conductor member and a plurality of resilient finger portions integrally joined at one end to the annular portion, the finger portions being arranged in a generally frusto-conical array having a major end disposed adjacent the wall means and outwardly of the wire receiving passages, the frusto-conical array of finger portions converging in a direction away from the wall means toward the conductor member. The resilient finger portions are engageable with the wires inserted into the cavity through the respective wire receiving passage to clamp the wires against the conductive member and provide a latchable connection between the wires. The central conductor member and the resilient clamp member are advantageously constructed and arranged so that they can be assembled into the insulating housing by axial insertion through an opening in the side of the housing. In a preferred embodiment of the invention, the wall means having the wire receiving passages therein is formed of metal.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

FIG. 1 is a longitudinal sectional view through one embodiment of the push-in electrical connector assembly of the present invention;

FIG. 2 is an end view of the connector assembly taken on the plane 2—2 of FIG. 1;

FIG. 3 is a transverse sectional view taken on the plane 3—3 of FIG. 1;

FIG. 4 is a sectional view through the metal clamp member;

FIG. 5 is a longitudinal sectional view through a modified form of the push-in electrical connector assembly, taken on the plane 5—5 of FIG. 6;

FIG. 6 is a transverse sectional view taken on the plane 6—6 of FIG. 5;

FIG. 7 is a longitudinal sectional view through the metal clamp member taken on the Plane 7—7 of FIG. 6;

DETAILED DESCRIPTION OF THE PREFERRED EMBODIMENTS

Figure 8:
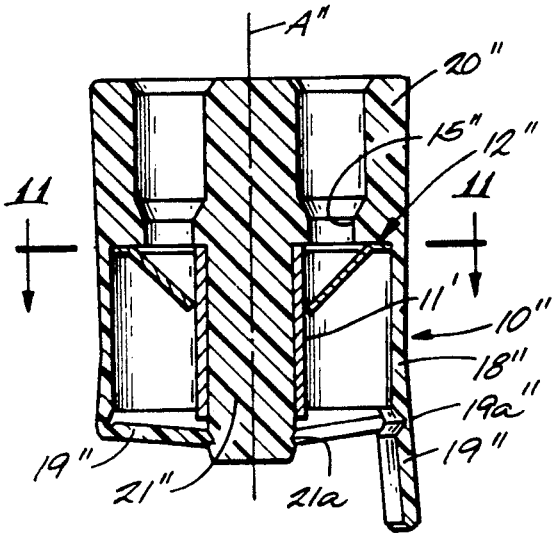
FIG. 8 is a longitudinal sectional view through a third embodiment of the push-in electrical connector assembly.
Figure 9:
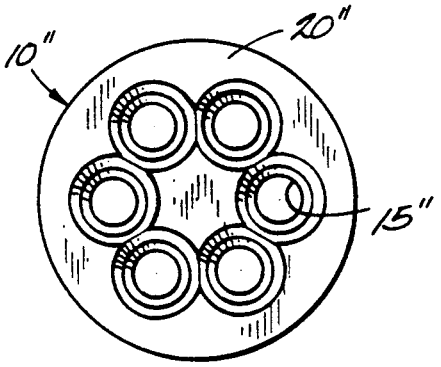
FIG. 9 is a top end view of the connector assembly shown in FIG. 8.
Figure 10:
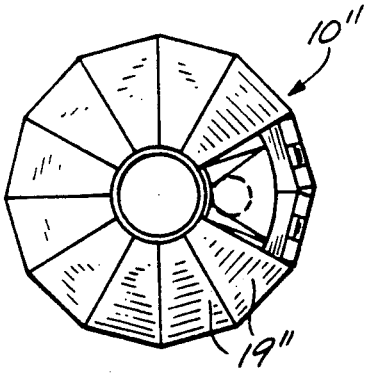
FIG. 10 is a bottom view of the connector shown in FIG. 8.
Figure 11:
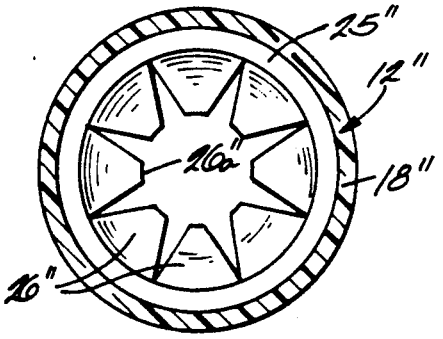
FIG. 11 is a transverse sectional view taken on the plane 11—11 of FIG. 8.
Figure 12:
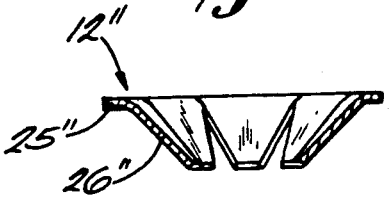
FIG. 12 is a sectional view through the annular clamp member used in the embodiment of FIG. 8.

The push-in electrical connector of the present invention functions to electrically connect the stripped ends of a plurality of wires W. The wires are preferably of the type having a solid core C and an insulating jacket J and can vary over a wide range of sizes, for example from A.W.G. 10 to A.W.G. 22.

The electrical connector in general includes a housing 10 formed of electrically insulating material such as plastic, defining an internal cavity, an elongated central conductor member 11 formed of electrically conductive metal and a generally frusto-conical clamp member 12 that surrounds the central conductor member and which is arranged to press the stripped ends of a plurality of wires into firm electrical contact with the central conductor member. A wall 14 is provided with a plurality of wire receiving openings or passages 15 arranged in a generally circular locus outwardly of the central conductor member 11.

In the embodiment of FIGS. 1–4, the housing is formed with a side wall 18 that is symmetrical with respect to a longitudinal axis A and an end wall 19 that extends across one end of the side wall. The side wall preferably has a generally circular cross-section as shown in FIGS. 2 and 3, it being understood that a side wall could be multifaceted or polygonal if desired. For reasons that shall become apparent hereinafter, the side wall 18 preferably has a slight outward taper in a direction from the end wall 19 toward the open end 20 of the housing.

The central conductor member 11 is axially elongated and is generally symmetrical with respect to the longitudinal axis A. In the embodiment shown, the central conductor member has a circular cross-section and is hollow, it being understood that the central conductor member could also have a multi-faceted or polygonal cross section if desired. In the embodiment of FIG. 1, the wall 14 is formed of metal and is integral with one end of the central conductor member and the wall 14 has a peripheral flange **14*a* at its radially outer edge that engages the inner side of the housing wall 18 to support the central conductor member coaxial with the axis A of the housing. The central conductor member 11 and wall 14 are preferably formed in one piece by stamping and push drawing from a piece of ductile, electrically conductive metal such as copper or brass. As shown in FIG. 1, the central conductor member is hollow with a slight upward taper to facilitate push drawing and is open at its upper end 11*a* and closed at the lower end 11*b***.

The generally frusto-conical clamp member 12 is formed of a resilient metal such as brass or beryllium copper and includes an annular or ring portion 25 spaced outwardly from the central conductor member 11, and a plurality of resilient finger portions 26 integrally joined at one end to the ring portion. As will be apparent from the following description, the annular or ring portion 25 can be of circular or polygonal configuration. The finger portions converge in a direction away from the wall 14 toward the central conductor member in a generally frusto-conical array, and the number of finger portions preferably corresponds to the number of wire receiving openings 15 in the wall 14, as best shown in FIG. 2. The distal ends **26*a* of the fingers 26 are preferably shaped to form a generally circular opening complimentary to the cross-section of the central conductor member and of a size such that the fingers engage the central conductor member prior to insertion of a wire between the finger and conductor member. The fingers are independently movable relative to each other and are preferably formed so that there is a slight slot therebetween as shown in FIGS. 3 and 4**, to facilitate independent movement of the fingers. The frusto-conical clamp member may, for example, be formed from flat sheet stock in a transfer press in which the stock is sequentially punched to form finger portions integrally connected along their major end to a band forming portion; stamped to bend the finger portions relative to the band forming portion; and the band forming portion thereafter rolled up or otherwise formed into a ring with the ends of the band forming portion interconnected as by a lock seam.

The ring portion of the frusto-conical member is arranged to engage the housing to support the frusto-conical member thereon. As best shown in FIG. 1, the ring portion engages the side wall of the housing in coaxial alignment with the central conductor member 11, and a shoulder **18*a* is provided on the side wall to engage and locate the frusto-conical member axially of the side wall, when the frusto-conical member is pushed into the housing. The outwardly extending wall 14 of the central conductor member is arranged to engage the frusto-conical member when it is pushed into the housing and a rib 18*b* is provided on the housing side wall 18 at a location to engage the flange portion 14*a* on the wall 14**, to retain the central conductor member and frusto-conical clamp member against withdrawal from the housing. With this arrangement, the frusto-conical clamp member and the central conductor member can be assembled in the housing by pressing the frusto-conical member and clamp member either sequentially or in the same operation into the housing.

The embodiment shown in FIGS. 5–7 is similar to that shown in FIG. 1. Like elements are designated with like reference numerals with the postscript ′ used to designate corresponding parts. The housing 10′ includes a side wall 18′ that is symmetrical with respect to the longitudinal axis A′ and an end wall 19′ at one end of the side wall. The central conductor member 11′ is disposed coaxial with the axis A′ of the housing. A metal wall 14′ extends outwardly from one end of the central conductor member and engages the side wall 18′ to radially support the central conductor member thereon. The other end of the central conductor is herein shown supported in a recess **19*a*′ in the end wall 19′. As in the preceding embodiment, conductor receiving openings 15′ are formed in the wall 14′** in a circular locus coaxial with the central conductor member.

In this embodiment, the frusto-conical member 12′ has an annular or ring portion 24′ of polygonal configuration as shown in FIG. 6 with the number of sides of the polygon, herein shown six in number, corresponding to the number of wire receiving openings in the plate 14'. As in the preceding embodiment, the resilient finger portions 26' are integrally joined at their major ends to the ring portion 25' and the finger portions are disposed in a generally frusto-conical array that converges in a direction away from the wall 14' to the central conductor member 11'. The distal ends 26a' of the finger portions have a concave configuration as shown in FIG. 6 and are arranged to engage the central conductor member 11' prior to insertion of a wire between the finger portion and the conductor member. The frusto-conical member 12' engages the side wall 18' and a shoulder 18a' on the housing to be radially and axially located thereby, and the wall 14' also engages the side wall of the housing to radially position the central conductor member, and a rib 18b' is provided on the side wall to retain the wall and conductor 11' in assembled relation in the housing.

Another embodiment of the invention is illustrated in FIGS. 8-12. Like numerals followed by the postscript " are used to designate parts corresponding to those described in connection with FIG 1. In this embodiment, the housing 10" has a side wall 18" symmetrical with respect to the lengthwise axis A". A central conductor member 11" is supported coaxial with the axis A" and a generally frusto-conical metal clamp member 12" has a ring portion 25" coaxial with and spaced outwardly from the axis A" and finger portions 26" that converge downwardly in a frusto-conical array toward the central conductor member 11". The housing 18" has an end wall 20" that extends across one end of the side wall and which has a plurality of conductor receiving passages 15" therethrough that communicate with the conductor receiving cavity. The housing also has a central core portion 21" coaxial with the axis A", and which extends through and supports the tubular conductor member 11". In this embodiment, the clamp members can be formed of a flat sheet of resilient metal stock by slitting and deforming the finger portions 26" out of the plane of the ring portion 25". As in the preceding embodiments, the distal ends 26a" are arranged to engage the central conductor member 11", prior to insertion of the wires through the wire receiving opening 15" into the conductor receiving cavity.

The housing 10" is formed so that the end opposite the wall 20' is open. This enables assembly of a tubular central conductor member 11' onto the housing core 21", and assembly of the clamp member into the housing to a position adjacent the wall 20', as shown in FIG. 8. In order to minimize the number of separate parts that must be assembled, a plurality of end wall segments 19" are formed integrally with the side wall 18 of the housing. The end wall segments 19" are hingedly articulated along a reduced thickness flex line 19a" for movement between a position extending generally lengthwise of the side wall 18" as shown at the lower right in FIG. 8, to a position extending from the side wall to the central core member 21", as shown at the lower left in FIG. 8. The core member is provided with a notch or recess 21a" for receiving the distal ends of the end wall segments 19" to releasably retain them in a position closing the end of the cavity.

From the foregoing it is believed that the construction and use of the push-in electrical connector assembly will be readily understood. The connector is constructed and arranged so that the conductor receiving passages are disposed in a generally circular locus to minimize the overall size of the connector assembly for electrically connecting any given number of wires. While the connector assemblies herein shown are arranged to electrically connect six wire conductors of different wire size, it will be apparent that connector assemblies can be formed to connect a lesser or greater number of wires for example four or eight wires, with only a relatively small change in overall size. The central conductor member is disposed internally of and coaxial with the circular locus wire receiving passages. The frusto-conical clamp extends around the central conductor member and is operative, when the wire is inserted through a respective one of the wire receiving passages, to radially press the wire against the central conductor member. With this arrangement, the plurality of wires inserted into the connector assembly are electrically connected to each other through the central connector member and through the metal clamp member. Furthermore, the annular clamping member functions to substantially isolate the clamping forces from the housing Thus, clamping forces exerted by a finger engaging a conductor at one side of the assembly are transmitted through the annular band portion and fingers to the central conductor member at the opposite side of the connector assembly.

While a particular embodiment of the invention has been shown and described, it will be obvious of those skilled in the art that changes and modifications may be made without departing from the invention in its broader aspects, and, therefore, the aim in the appended claims is to cover all such changes and modifications as fall within the true spirit and scope of the invention.

I claim:

1. A push-in electrical connector assembly for electrically connecting the stripped ends of a plurality of electrical wires, said connector assembly comprising:

a housing having an interior cavity;

an elongate electrically conductive member disposed within said interior cavity;

a wall at one end of said interior cavity defining a plurality of wire receiving passages communicating with said interior cavity and arranged in a generally circular locus around said electrically conductive member; and retaining means within said interior cavity and separate from said electrically conductive member for biasing the stripped ends of the electrical wires into contact with said electrically conductive member and for resisting withdrawal of the stripped ends of the electrical wires from said interior cavity when the stripped ends of the electrical wires are inserted into said interior cavity through said wire receiving passages.

2. A push-in electrical connector assembly as defined in claim 1 wherein said wall and said electrically conductive member are integrally formed and comprise a single unitary structure.

3. A push-in electrical connector assembly as defined in claim 1 wherein said retaining means is electrically conductive.

4. A push-in electrical connector assembly as defined in claim 1 wherein said retaining means comprises a plurality of resilient fingers surrounding and converging toward said conductive member within said interior cavity.

5. A push-in electrical connector assembly as defined in claim 4 wherein said retaining means comprises a generally frusto-conical clamp member of resilient metal having integrally formed thereon said resilient fingers.

6. A push-in electrical connector assembly for electrically connecting stripped ends of a plurality of electrical wires, the connector assembly comprising;

a housing of electrically insulating material defining a connector cavity;

wall means at one side of said cavity providing a plurality of wire receiving passages communicating with said cavity and arranged in a generally circular locus;

an axially elongated central conductor member of electrically conductive material disposed in said cavity with a longitudinal axis thereof aligned with the center of said circular locus, and a generally frusto-conical metal clamp member of resilient metal disposed in said cavity and having an annular portion spaced outwardly of the central conductor member and a plurality of resilient finger portions integrally joined at one end to said annular portion, said finger portions converging in a direction away from said wall means toward said central conduction member, said resilient finger portions being engageable with wires inserted into the cavity through respective wire receiving passages to press the wires against the conductor member and electrically connect the wires.

7. A push-in electrical connector assembly according to claim 6 wherein said annular portion engages said housing for support thereon.

8. A push-in electrical connector assembly according to claim 6 wherein said wall means comprises a me[al wall extending outwardly from one end of the central conductor member, said conductor receiving passages being formed in said metal wall.

9. A push-in electrical connector assembly according to claim 6 wherein said wall means is formed of electrically insulating material and is fixed to said housing.

10. A push-in electrical connector assembly according to claim 6 wherein the number of wire receiving passages is equal to the number of resilient finger portions.

11. A push-in electrical connector assembly according to claim 6 wherein said central conductor member is hollow.

12. A push-in electrical connector assembly according to claim 6 wherein said wire receiving passages are equi-angularly spaced about the lengthwise axis of said central conductor member.

13. A push-in electrical connector assembly according to claim 6 including means mounting the central conductor member on the housing for support thereon.

14. A push-in electrical connector assembly according to claim 13 wherein the annular portion engages the housing for support thereon concentric with the lengthwise axis of the central conductor member.

15. A push-in electrical connector assembly according to claim 6 wherein the wall means comprise a metal wall integral with one end of the conductor member and extending outwardly therefrom into engagement with said housing, said conductor receiving passages being formed in said metal wall.

16. A push-in electrical connector assembly according to claim 15 including means on said housing for supportably engaging an end of said central conductor member remote from said one end.

17. A push-in electrical connector assembly according to claim 6 wherein the number of wire receiving passages is not less than five.

18. A push-in electrical connector assembly according to claim 17 wherein the number of wire receiving passages is equal to the number of resilient finger portions.

19. A push-in electrical connector assembly according to claim 6 wherein said central conductor member has a tubular configuration and said housing has a core portion of electrically insulating material extending into said conductor member to locate said conductor member in said housing.

20. A push-in electrical connector assembly according to claim 19 wherein said housing has a side wall around the cavity and an end wall at a second side of the cavity opposite said wall means, said end wall comprising a plurality of wall segments articulated along flexible hinge lines to the side wall of the housing for movement between a closed position extending from said side wall to said core and a position opening said second side of the cavity.

21. A push-in electrical connector assembly for electrically connecting stripped ends of a plurality of wire conductors, the connector assembly comprising:

an elongate housing of electrically insulating material having a side wall symmetrical with respect to a longitudinal axis and an end wall at one end of the side wall;

a central conductor member disposed in the housing along said longitudinal axis of said side wall:

a metal wall extending outwardly from one end of the central conductor member at a location spaced from said end wall and defining a Conductor receiving cavity in said housing between said metal wall and said end wall, said metal wall having a plurality of wire receiving passages therethrough arranged in a generally circular locus concentric with said longitudinal axis of the central conductor member; and a generally frusto-conical metal clamp member of resilient metal disposed in said cavity and having an annular portion spaced outwardly from said central conductor member and a plurality of resilient finger portions integrally joined at one end to the annular portion and converging in a direction away from said metal wall toward said central conductor member, said resilient finger portions being engageable with wires inserted through said wire receiving passages into said cavity to clamp the wires against said central conductor member and electrically connect the wire conductors.

22. A push-in electrical connector assembly according to claim 21 wherein said annular portion of said resilient clamp member engages and is supported on the side wall of the housing.

23. A push-in electrical connector assembly according to claim 22 wherein said metal wall engages the annular portion of the clamp member.

24. A push-in electrical connector according to claim 22 wherein the metal wall engages and is supported on the side wall of the housing.

* * * * *